US008202083B2

(12) United States Patent
Enache et al.

(10) Patent No.: US 8,202,083 B2
(45) Date of Patent: Jun. 19, 2012

(54) PROCESS AND INSTALLATION FOR INCREASING THE BURNING ENERGY PRODUCED BY A NATURAL FUEL GAS

(76) Inventors: Aurel Enache, Buzau (RO); Liviu Luca, Ploiesti (RO)

( * ) Notice: Subject to any disclaimer, the term of this patent is extended or adjusted under 35 U.S.C. 154(b) by 755 days.

(21) Appl. No.: 11/920,965

(22) PCT Filed: May 19, 2006

(86) PCT No.: PCT/RO2006/000010

§ 371 (c)(1), (2), (4) Date: Nov. 23, 2007

(87) PCT Pub. No.: WO2006/126905

PCT Pub. Date: Nov. 30, 2006

(65) Prior Publication Data

US 2009/0325109 A1 Dec. 31, 2009

(30) Foreign Application Priority Data

May 26, 2005 (RO) ..... 05-0503
Mar. 23, 2006 (RO) ..... 06-0191

(51) Int. Cl.
*F23D 14/68* (2006.01)

(52) U.S. Cl. ..... 431/2; 431/3; 110/218; 210/223; 95/27; 95/28; 95/57

(58) Field of Classification Search ..... 431/2, 3; 110/218; 210/223; 95/27, 28, 57
See application file for complete search history.

(56) References Cited

U.S. PATENT DOCUMENTS

| | | | | | |
|---|---|---|---|---|---|
| 3,277,631 | A | * | 10/1966 | Sunnen | 95/28 |
| 3,355,609 | A | * | 11/1967 | Horn et al. | 310/11 |
| 3,439,899 | A | * | 4/1969 | Hershler | 366/101 |
| 4,136,016 | A | * | 1/1979 | Rosensweig | 208/134 |
| 4,238,183 | A | * | 12/1980 | Robinson | 431/2 |
| 4,254,557 | A | * | 3/1981 | Mayer et al. | 34/249 |
| 4,254,558 | A | * | 3/1981 | Mayer | 34/249 |
| 4,755,288 | A | * | 7/1988 | Mitchell et al. | 210/85 |
| 5,637,226 | A | * | 6/1997 | Adam et al. | 210/695 |
| 5,882,514 | A | * | 3/1999 | Fletcher | 210/223 |
| 5,888,060 | A | * | 3/1999 | Velke | 431/11 |
| 6,235,202 | B1 | * | 5/2001 | Ohkawa | 210/695 |
| 6,512,215 | B2 | * | 1/2003 | Dalton | 219/759 |

FOREIGN PATENT DOCUMENTS

| | | |
|---|---|---|
| GB | 2323215 B | 9/1998 |
| JP | 612 116 19 A | 9/1986 |
| WO | 2006048694 A1 | 5/2006 |

* cited by examiner

*Primary Examiner* — Steven B McAllister
*Assistant Examiner* — Avinash Savani

(57) ABSTRACT

A process and an installation for increasing the burning energy of a natural fuel gas upon burning the same for domestic or industrial purposes. The process includes the step of supplying the natural gas into a treatment chamber confined by a cylindrical-shaped wall made up of a diamagnetic material, in front of which electromagnetic units are placed in a spiral shape to create a rotating magnetic field which acts on the gas with only one polarity. The installation has a reactor equipped with electromagnetic units and with a heat circuit, with an oil tank, where a number of electric resistors are placed in order to heat the oil, a pump, an oil cooler and a circuit for the transport of oil from the tank to the electromagnetic units of the reactor, an electric panel, and conduits for the transport of the natural gas.

6 Claims, 11 Drawing Sheets

Figure 1:
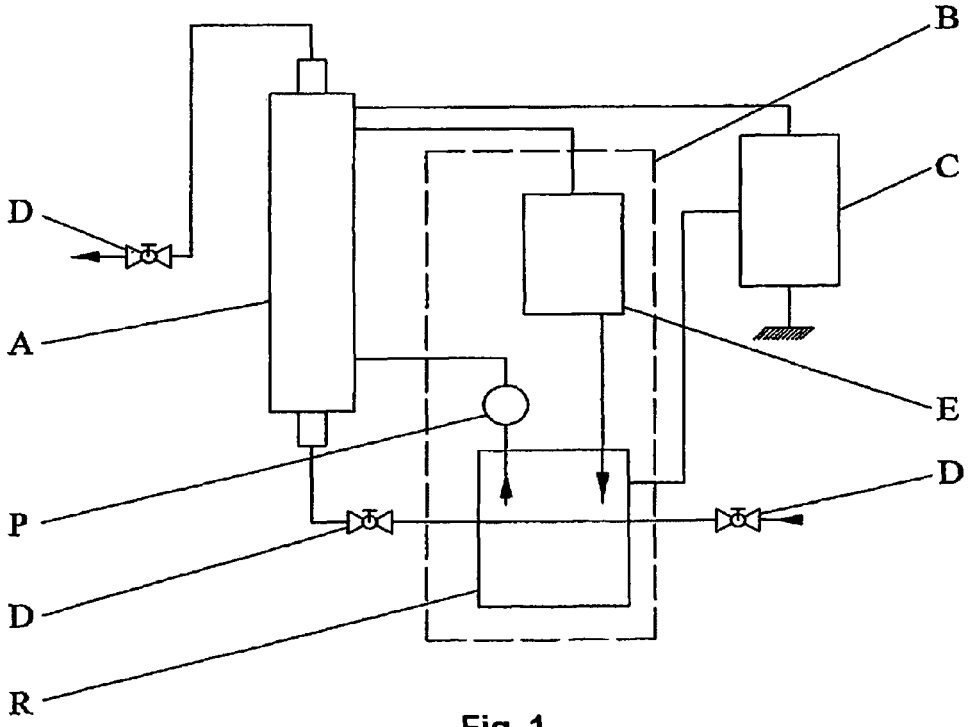

PROCESS AND INSTALLATION FOR INCREASING THE BURNING ENERGY PRODUCED BY A NATURAL FUEL GAS

The invention refers to a process and an installation for increasing the burning energy of a natural fuel gas upon burning the same for domestic or industrial purposes.

There are known a process and a device, as disclosed in the U.S. Pat. No. 4,238,183, for increasing the efficiency of the natural fuel gas. The process comprises supplying the natural gas into an inlet chamber, at the bottom of a first housing, passing the natural gas through a plurality of holes grouped within several spaced arrays on a distributor plate in the inlet chamber into a magnet chamber having a plurality of sets of vertically arranged magnets, placed in front of the hole arrays, each of them producing a magnetic flux which acts on the natural gas in order to magnetically treat the natural gas passing through the sets of magnets, thereafter, the natural gas is discharged from the magnet chamber at its upper side, and an inlet chamber located at the bottom of the second housing is supplied with this gas, said inlet chamber is located downstream from the first housing, wherein the natural gas passes, through a plurality of holes grouped within several spaced arrays on a distributor plate in the second housing, into another magnet chamber in the second housing which has a plurality of sets of vertically arranged magnets placed in front of the holes arrays, each of them producing a magnetic flux which acts on the natural gas passing upwards through the sets of magnets, and which has undergone a magnetic field treatment in the first magnet chamber, in the end, the natural gas thus treated is supplied to a burner wherein the combustion of the gas takes place.

The device for increasing the efficiency of the fuel consisting of a natural gas comprises a natural gas source, a first housing containing a first inlet chamber at the lower side of the said first housing, the said natural gas source communicating with the first inlet chamber for supplying natural gas thereto, a first magnet chamber in the first housing being located downstream from the first inlet chamber, said magnet chamber having a plurality of sets of vertically arranged magnets for applying a magnetic flux to the natural gas flowing upwards through the magnets, said first inlet chamber and the first magnet chamber being separated from each other by a distributor plate having a plurality of spaced holes extending in a plurality of spaced arrays for supplying the natural gas into the first magnet chamber, a second housing being located downstream from the first housing and having a second inlet chamber communicating with the first chamber wherein the sets of magnets in the first housing are placed, so that the natural gas thus treated be supplied into the second housing, a second magnet chamber in the second housing being located downstream from the second inlet chamber, a plurality of sets of vertically arranged magnets being in this magnet chamber for generating a magnetic flux which is applied to the treated natural gas passing upwards therethrough, the second inlet chamber and the second magnet chamber being separated from each other by means of a distributor plate provided with a plurality of holes grouped in a plurality of spaced arrays and extending on the entire plate surface for supplying the second magnet chamber with the treated natural gas flowing through the sets of magnets, the treated gas being discharged from the second magnet chamber and directed towards a burner located downstream from the second magnet chamber, for combusting the treated natural gas.

The disadvantages of the process and the device consist in that each set of ring-shaped magnets generates a magnetic field producing an axial magnetic field resultant which determines a reduced action on the increase of the natural gas molecule energy, if the temperature of the natural gas passing through the sets of magnets is not correlated with the zero fluctuations of the vacuum, fact that determines the increase of the burning energy. As the gas energy increase is relatively low, several modules for the gas treatment in series have to be mounted, in order to ensure, under these circumstances, the correlation between the gas mass and the magnetic flux treating the natural gas.

The technical problem solved by this invention consists in ensuring some optimum conditions for increasing the burning energy of the natural fuel gas under the circumstances of an optimum correlation between the physical-chemical factors which achieve this increase of energy, namely, between the magnetic field action and the thermal field action upon the moving natural gas molecule.

According to the invention, the process eliminates the disadvantages shown before in that it comprises the steps of supplying the natural gas, which natural gas can preferably be methane, through a treatment chamber confined by a cylindrical-shaped wall made up of a diamagnetic material, in front of which some electromagnetic units are placed in a spiral shape, of said electromagnetic units the terminal ones are diametrically opposed relatively to the longitudinal vertical axis of the chamber, thereby creating a rotating magnetic field which acts on the gas with only one polarity, under the circumstances in which a rotating thermal field created by the cores of the electromagnetic units maintained at a temperature in a range between 31° C. and 65° C. acts simultaneously on the gas, thereby an energy transfer being ensured, from the zero fluctuations of the vacuum towards the mass of natural gas passing upwards through the said chamber, before entering the chamber, the gas being pre-heated and having a temperature between 18° C. . . . 30° C. and in the end, the gas thus treated is directed towards a burner.

Within this process, the electromagnetic units can be supplied with electric power having the same intensity, if parallelly connected, or different intensities if serially connected, with decreasing values in the direction of the natural gas flow through the treatment chamber; situation in which the value of the magnetic field ranges between 0.1 and 0.8 T, each electromagnetic unit being maintained at the same temperature ranging between 31° C. and 65° C.

According to the invention, characteristic to the process is also the fact that the magnetic flux provided by the core of each electromagnetic unit has a value ranging between 0.03 W . . . 0.228 W, irrespective of the connection in series or parallel of the electromagnetic units.

According to the invention, the installation for increasing the burning energy produced by the natural fuel gas, wherein the said process is applied, comprises a reactor provided with some electromagnetic units and with a heating circuit which consists of a tank for storing the oil used as a thermal medium for heating the natural gas, in said tank there being placed a number of electric resistors for heating the oil, a pump for handling the oil, an oil cooler and a circuit for transporting the oil from the tank to the electromagnetic units of the reactor, as well as an electric panel for the power supply to the reactor and several natural gas transporting pipes.

Another characteristic of the invention consists in that the electromagnetic units which are arranged about a pipe made up of a diamagnetic material have several metal cores in contact with the pipe wherethrough the pre-heated natural gas passes, said cores being arranged on stages each comprising three units, each stage being rotated relatively to the previous stage by an angle ranging between 70° and 73°, so that a complete rotation of 360° between the first and the last stage be achieved, the electromagnetic units being positioned by their being inserted into a number of holes of a thermally insulating support.

Another characteristic of the invention consists in that each electromagnetic unit has a metal core placed into an electric coil, a heat exchange tank having the role of maintaining the electromagnetic unit at a constant temperature, and a series of electrical connection ends.

Another characteristic of the invention consists in the fact that, inside the heat exchange tank, the oil used as a thermal medium is introduced through a supply pipe and is taken over therefrom through a discharge pipe, said pipes having equal diameters, but the length of the supply pipe being longer than the length of the other pipe, the ratio between these lengths being in the range between 2 and 2.5, all the heat exchange tanks being serially connected through the supply pipe of one unit and the discharge pipe of the following unit.

Another characteristic of the invention consists in that the ratio between the diameter of the pipe passing through the reactor and the conduit for the natural gas supply connected therewith is between 3 and 6.

The process and the installation have the following advantages:

- they achieve the increase of the burning energy of the natural gas so that the heat yield upon combusting the natural gas increases by minimum 12%, without any further supply of fuel material;
- they lower the quantity of noxious substance and of carbon monoxide in the flue gases;
- the installation is highly reliable as it uses electromagnets;
- the installation is adaptable to any type of natural fuel gas consumer;
- the ratio between the electric power consumed for operating the reactor and the supplementary energy extracted from the zero fluctuations of the vacuum is of maximum 1/24;
- the installation has a compact structure.

Figure 2:
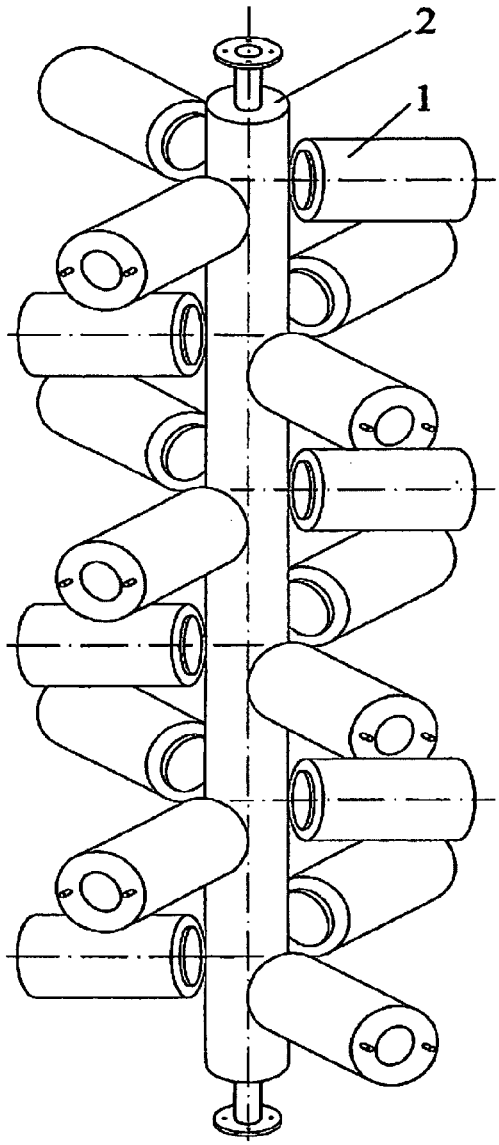
Figure 3:
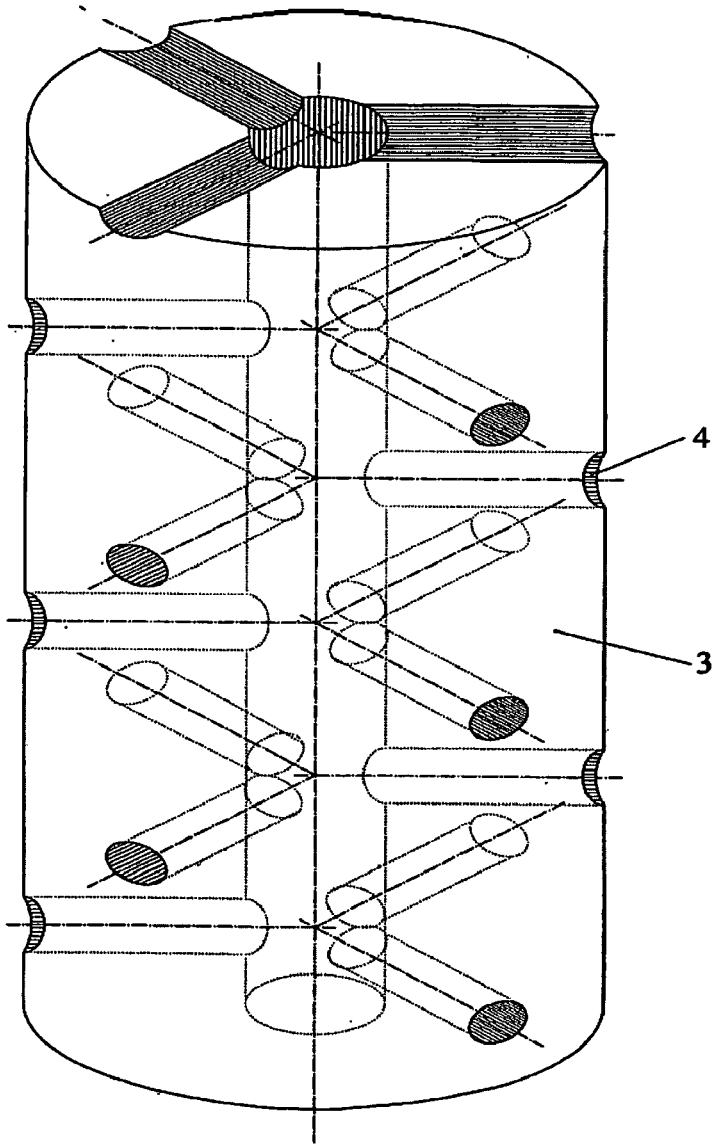
Figure 4:
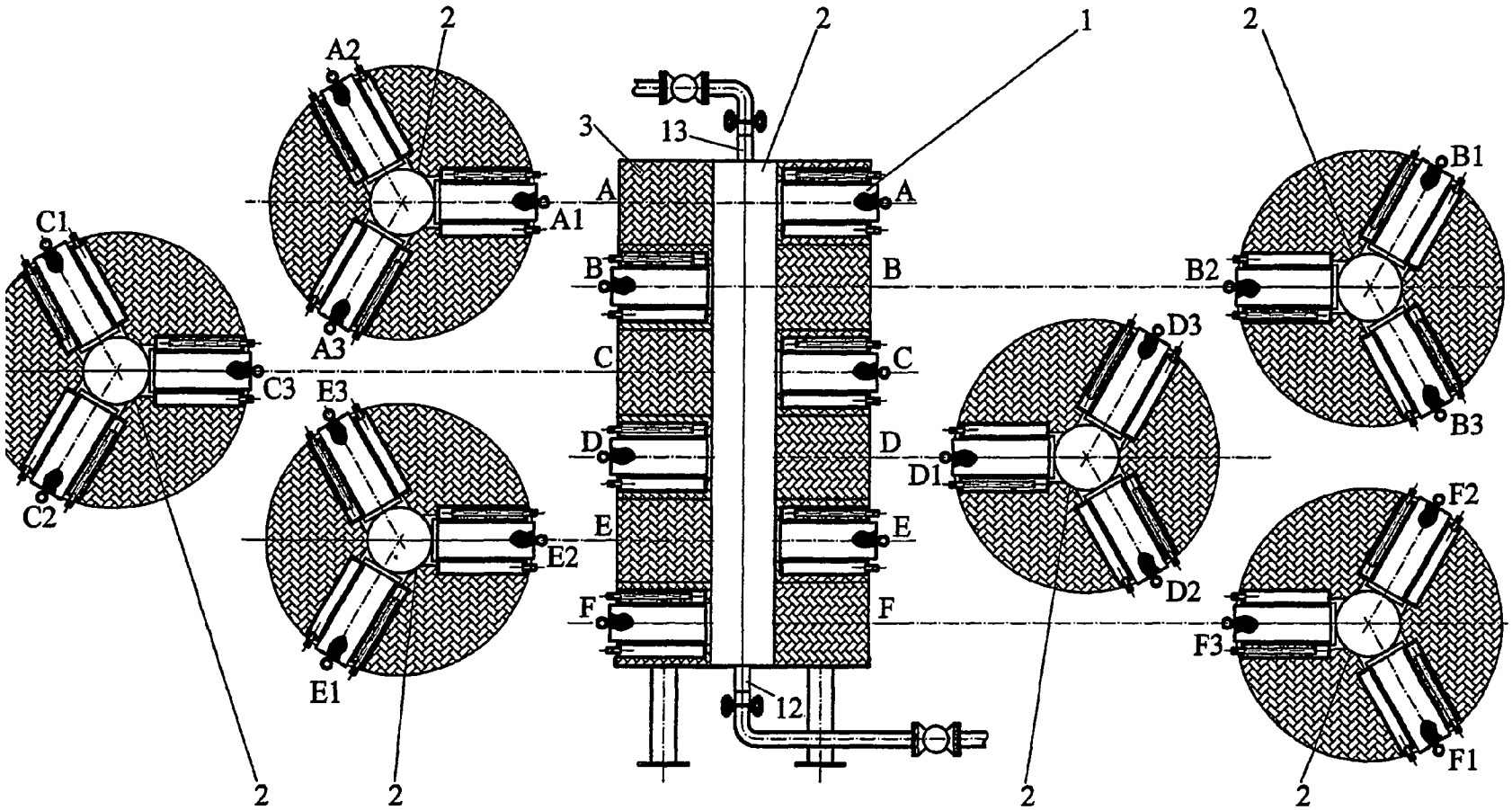
Figure 5:
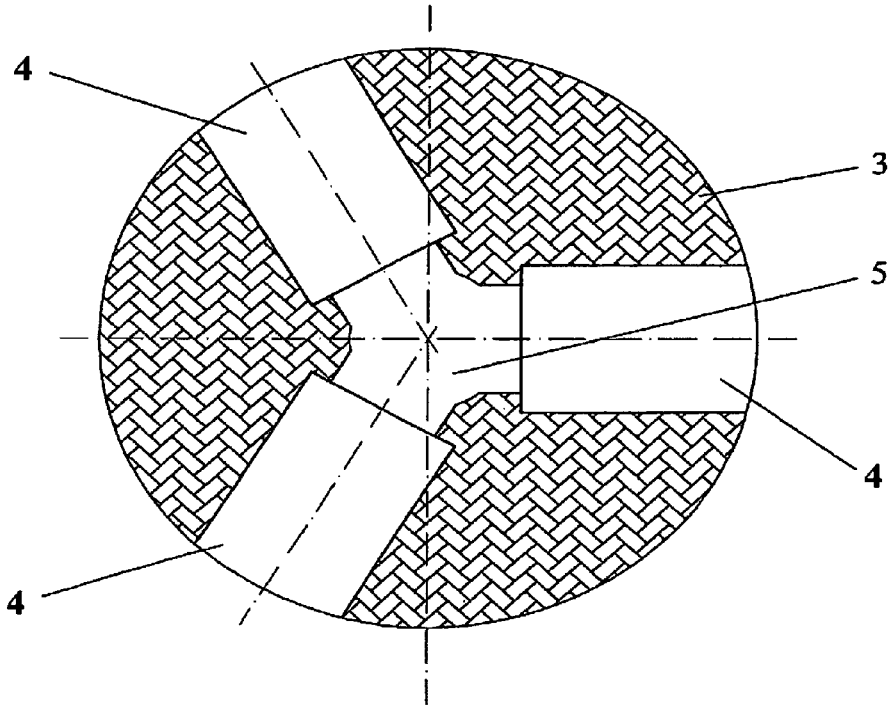
Figure 6:
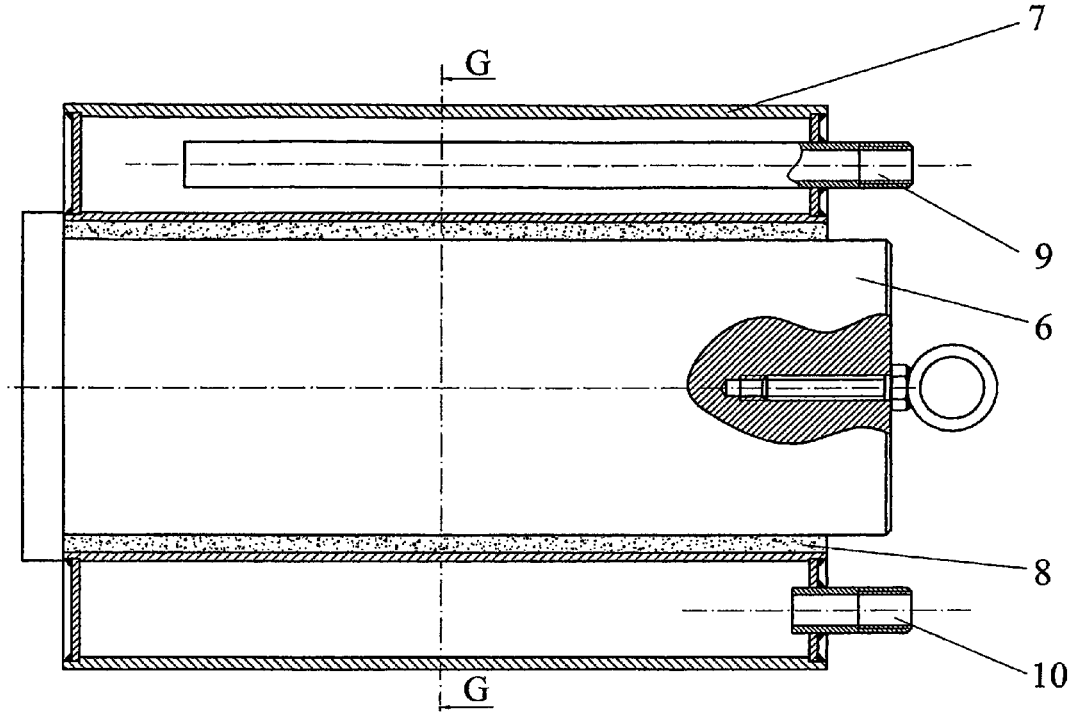
Figure 7:
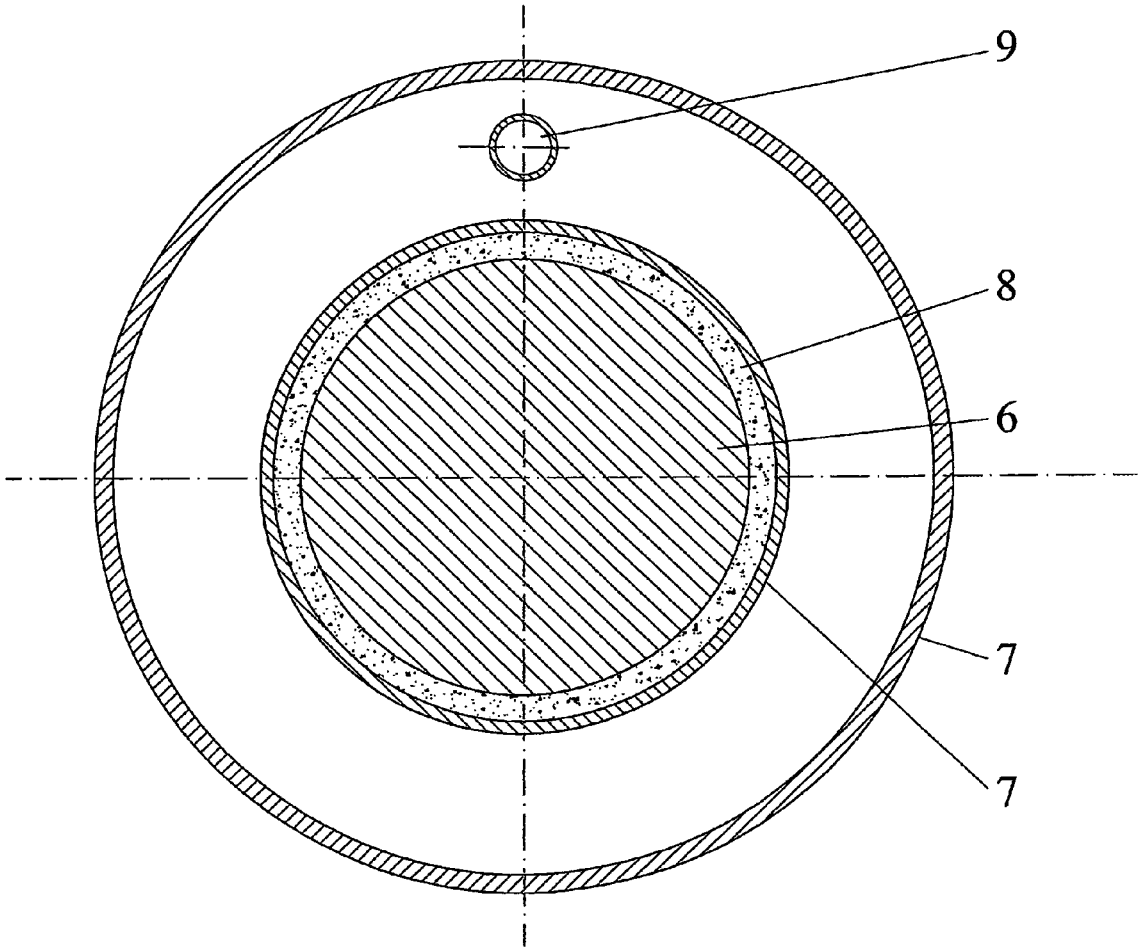
Figure 8:
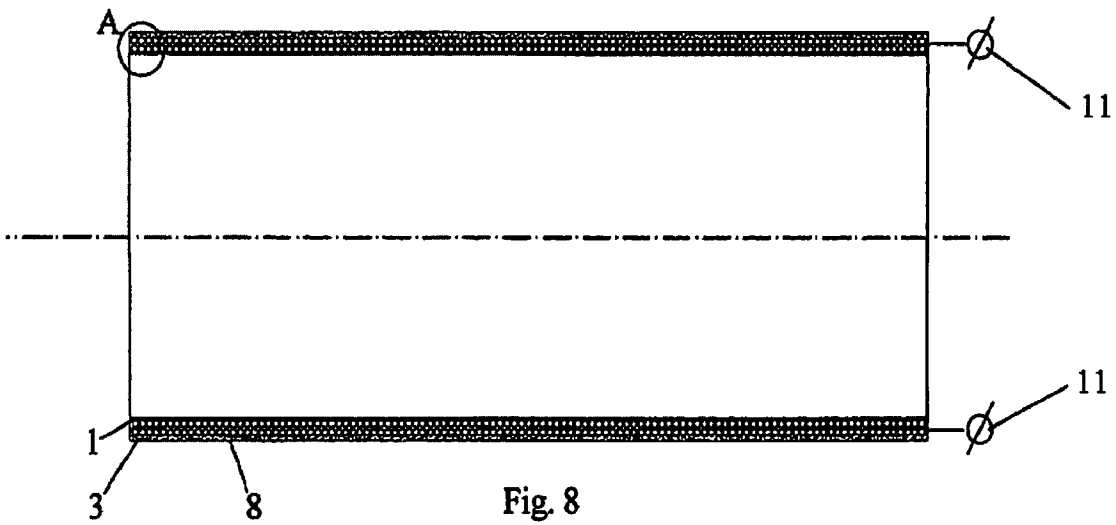
Figure 9:
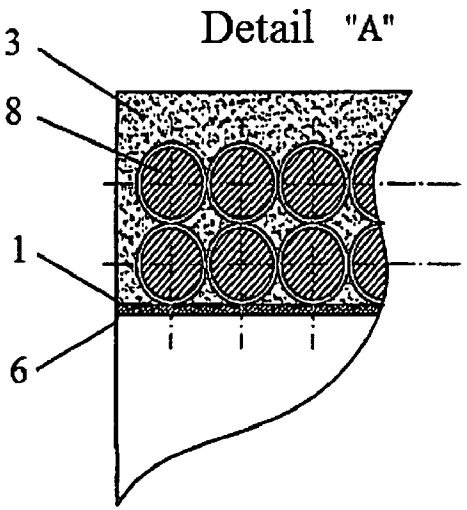
Figure 10:
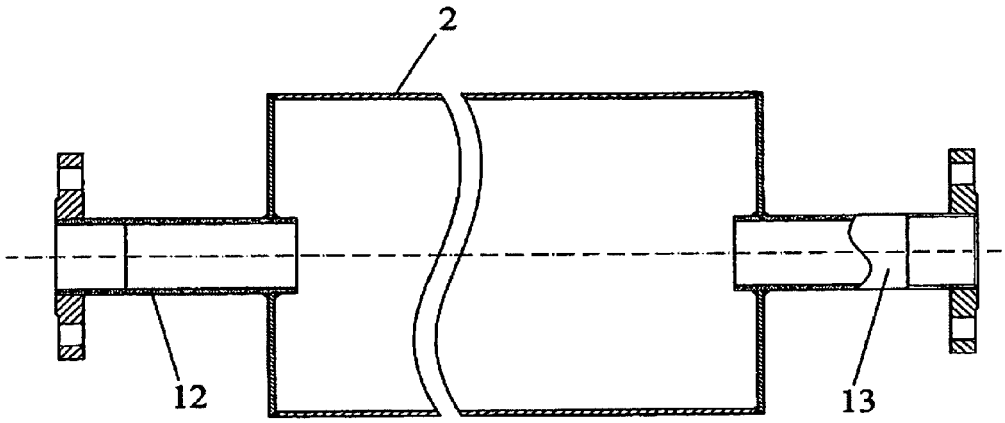
Figure 11:
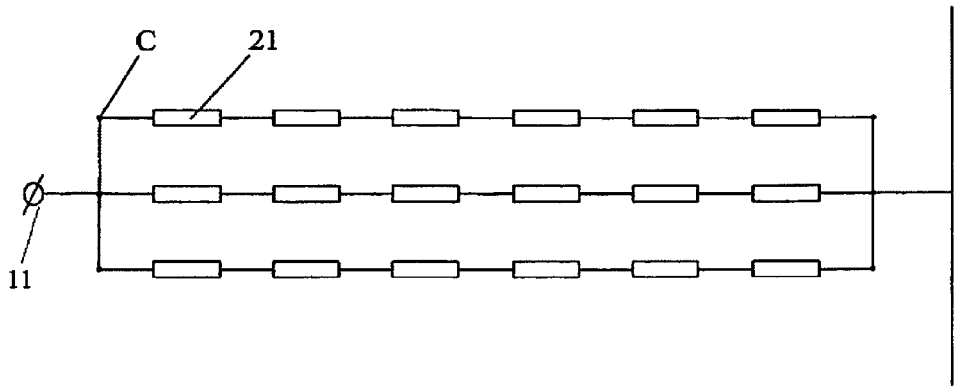
Figure 12:
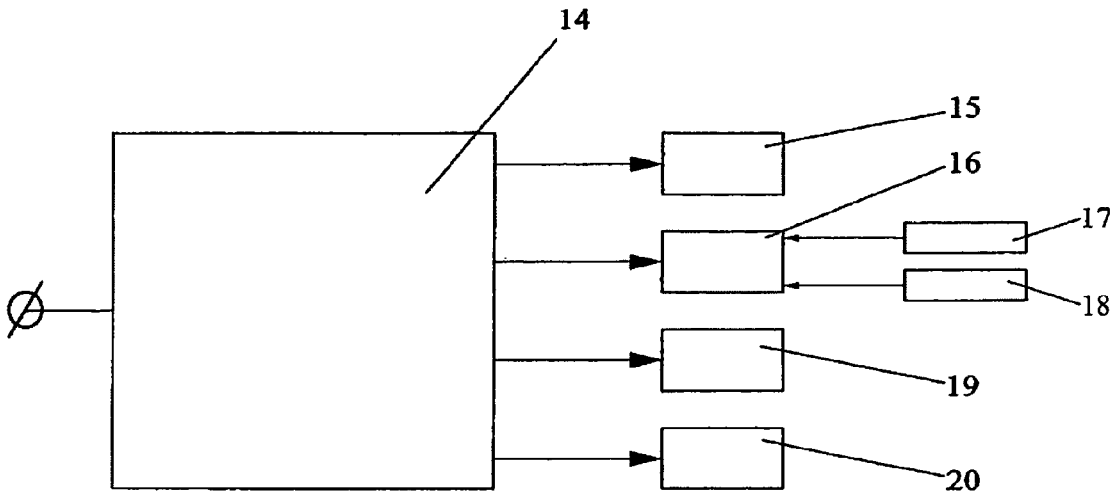

There is given hereinafter an example of carrying out the process and the installation claimed by the invention, in connection with the FIGS. 1-12, which represent:

FIG. 1, scheme of the installation for increasing the burning energy produced by the natural gas;

FIG. 2, spatial view of the electromagnetic units;

FIG. 3, spatial view of the electromagnetic units support;

FIG. 4, longitudinal sections and transverse section about the plans A-A, B-B, C-C, D-D, E-E, F-F through the reactor;

FIG. 5, section about the plan G-G through the reactor, with the electromagnetic units not mounted;

FIG. 6, longitudinal section through the electromagnetic unit with fracture in front of the maneuvering hook;

FIG. 7, transverse section according to plan H-H through the electromagnetic unit;

FIG. 8, longitudinal section through the electromagnetic unit coil;

FIG. 9, constructive detail "A";

FIG. 10, longitudinal section through the diamagnetic pipe;

FIG. 11, scheme of the electric power supply of the electromagnetic units coils;

FIG. 12, scheme of the electric panel.

The installation for increasing the burning energy produced by the natural gas comprises a reactor A and a heat circuit B. The heat circuit comprises a tank R for the oil used as a thermal medium which heats the natural gas, wherein there are placed a number of electric resistors, not shown in figures, for heating the oil, an oil cooler E; a pump P to push the oil, a circuit not shown in the figures for the transport of the oil from the tank R to a series of electromagnetic units 1 in the reactor A. There is also an electric panel C for the electric power supply of the pump P, and several conduits D for the transport of the natural gas.

The reactor A comprises the units 1, which are preferably 18 in number, being geometrically arranged three by three on a stage, situation in which each stage is rotated relatively to the previous stage by an angle of 72 degrees. The units 1 are arranged inside a thermally insulating support 3, preferably made up of wood, each being positioned in one of the holes 4. Each unit 1 has a metal core 6, whose surface is in direct contact with a vertical pipe 2 made up of a diamagnetic material, which confines a treatment chamber a.

An electromagnetic unit 1 comprises a metal core 6, an electric coil 8 used as a source of generating a magnetic field. The coils 8 of the units 1 are power supplied through a number of connecting ends 11, preferably arranged on three rows, connected in parallel, to six coils 21 serially connected within the wiring diagram of the electric panel C. Each unit 1 is equipped with a heat exchange tank 7 having the role of maintaining the unit 1 at a constant temperature ranging between 31° C. and 65° C. By maintaining the unit 1 at the working temperature, there is greatly increased the probability of connection between the magnetic field produced by the metal core 6 placed inside the coil 8, and the magnetic momentum of spin of the zero pairs. The oil used as a thermal medium flows inside the tank 7, being introduced thereinto through a supply pipe 9, and wherefrom it is taken over by a discharge pipe 10.

The pipes 9 and 10 have equal diameters, but the pipe 9 is longer than the discharge pipe 10, the ratio between their lengths being of 2-2.5, so as to have a swirling flow of oil inside the tank 7, fact that leads to a uniform heating or cooling of the electromagnetic unit 1. The oil takes over the heat in excess or brings a heat uptake in the case of a temperature lower than the working temperature, such operations being necessary for maintaining the unit 1 at the working temperature. The pipe 9 of a unit 1 is connected to the pipe 10 of the following electromagnetic unit 1, in the succession of the 18 units 1, thereby achieving the series connection of all 18 tanks 7, so that the oil pushed by the pump P could pass successively therethrough.

The circuit B provides the heating of the oil through the heating resistors placed inside the tank R wherein the oil is stored. At the same time the cooling of the oil can also be carried out by its being passed through the oil radiator E. The pumping of the oil into the tanks 7 of the 18 units 1 is achieved by means of the pump P through the conduits D, which carry out both the oil supply of the electromagnetic units 1 and the transfer of the oil discharged therefrom.

The oil transport circuit comprises thermally insulated conduits D which make the series connection of the tanks 7 in the 18 electromagnetic units 1 with the oil tank R by means of the pump P which carries out the oil flow in closed-circuit. The oil radiator E for cooling the oil is located within the oil transport circuit and is driven only when there is necessary to discharge the heat in excess, as a consequence of exceeding the working temperature.

The electric panel C carries out the electric power supply by means of a rectifier 20 which supplies electric power at a required voltage for generating the magnetic field to all the 18 units 1. Also, the electric panel C provides the power supply of the electric resistors inside the tank R, as well as the power supply needed for driving a ventilating unit that the cooler E is equipped with, in order to cool the oil and to drive the pump P. In order to maintain the 18 electromagnetic units 1 at an established working temperature, a thermocouple 17 for the oil and a thermocouple 18 for the units 1 are provided, together with a number of relays 16 for driving the pump P supplied with electric power from the electric panel C. From a central unit 14 there are actuated the power supply and the disconnection of the relays 15 and 16, of the thermocouples 17, 18 and 19, and of the rectifier 20, in order to maintain the units 1 at the working temperature by correlating the values of the temperature parameters given by the thermocouple 17 for the oil and by the thermocouple 18 set in each electromagnetic unit 1. The central unit 14 also controls the power supply of the electric resistors in the tank R and the pump P when the temperature of the electromagnetic units 1 is lower than the temperature needed for the reactor A. Through these controls, the oil is heated in the tank R by means of the electric resistors, and circulated through the heat circuit by means of the pump P, thereby getting into the tanks 7 of the units 1, fact that leads to the heating of the metal core 6, which thus reaches the optimum temperature needed for the connection with the zero fluctuations of the vacuum for increasing the burning energy released upon the combustion of the gas treated in the reactor A. The central unit 14 also controls the cooling of the units 1 by ceasing the power supply of the electric resistors when the thermocouple 18 records a higher temperature than the temperature needed in the reactor A. By flowing the oil inside the cooler E and by starting-up the cooling ventilating unit, the oil is cooled, releasing the heat in excess taken over from the units 1 through the heat exchange tanks 7, outside the reactor A. Thus, the units 1 are cooled and their temperature is lowered up to reaching the working temperature of the reactor A, when the zero vacuum energy can be extracted for increasing the burning energy produced by the natural gas flowing through the reactor A. The heating and the cooling of the electromagnetic unit 1 is achieved in an optimum time interval when the heated or cooled oil, as the case may be, is introduced into each tank 7 through the pipe 9 and is discharged through the pipe 10, thereby achieving a swirling flow without high temperature gradients inside the electromagnetic unit 1.

In the situation when the electromagnetic units 1 are supplied with electric power having the same or different intensities according to their being connected in series or in parallel, the decreasing values of the magnetic field can be ensured, in the flowing direction of the natural gas through the treatment chamber confined within the pipe 2, in said situation, the value of the magnetic field being between 0.1 . . . 0.8 T, each electromagnetic unit being maintained at the same temperature ranging between 31° C. . . . 65° C.

In this situation, the magnetic flux is ensured by the core 6 of each electromagnetic unit 1, which has a value ranging between 0.030 . . . 0.228 Wb, irrespective of the connections in series or in parallel of the electromagnetic units 1.

The series or parallel connections of the electromagnetic units 1 should preferably be carried out in series in hot weather (in summer, respectively), and in parallel in cold weather (in winter, respectively).

The coil 8 provides, by means of the core 6, a continuous magnetic field outside thereof.

This field is necessary for the operation of the electromagnetic unit 1 in order to balance, in the area adjacent to the diamagnetic pipe 2, the magnetic momentum of the zero pairs occurring upon the vacuum fluctuation. By providing the connection between the magnetic field of the electromagnetic unit 1 maintained at the working temperature of the reactor A, and the magnetic momentum of the zero vacuum pairs, there becomes possible the extraction of energy which is added to the energy of the natural gas molecule passing through the pipe 2.

The natural gas path consists of a conduit crossing the oil tank R, which makes a pre-heating of the natural gas, the pipe 2 which passes axially through the reactor A, crossing a hole 5 cut in the support 3 for the electromagnetic units 1. The pipe 2 carries out the natural gas exposure to the physical action of the electromagnetic units 1, being in direct contact with the ends of the metal cores 6, and it is connected to the pre-heated gas conduit through a supply connection 12. A connection 13 for the outlet of the natural gas achieves the connection between the diamagnetic pipe 2 and the natural gas burners not shown in figures.

For example, upon the combustion of the natural gas, there are obtained about 8125 Kcal/$m^3$-heat in the conditions of an optimum air-gas mixture. By the extraction of a part of the zero vacuum energy in the reactor A, the heat obtained from the combustion can be increased up to 11375 Kcal/$m^3$, this increase implicitly leading to the reducing of the gas consumption.

Due to the fact that the zero fluctuations of vacuum take place in a medium with a controlled constant thermal gradient, they have a duration tending towards the maximum possible duration, so that, within the vacuum, the existence of the particle-antiparticle pairs leads to the occurrence of a metric fluctuation to the effect that the distance between two points oscillates about a maximum external average value.

The occurrence and the disappearing of the particle-antiparticle pairs lead to space oscillations. Because of this fact, there exists a metrics fluctuation at the quantum level of the space, to the effect that the distance between two points oscillates about an average value. According to the Heisenberg principle, these fluctuations have an extremely short existence.

Within an atom having energy levels very well-established by the quantum mechanics formalism, the displacements of the energy levels of the electrons in the atom due to the zero fluctuation of the vacuum are emphasized by the Lamb effect.

Formally, the fluctuation of the spatial metrics modifies the eigen values of the energy levels for the layers of electrons within the atoms, the Srodinger equation having in this case a dynamic aspect. These changes within the energy spectrum of the electrons inside the atoms last for an extremely short period of time, according to the life time of the zero fluctuations of the vacuum, the possible energy in excess released within an exothermal chemical reaction being imperceptible. LAMB SHIFT & VACUUM POLARIZATION CORRECTIONS TO THE ENERGY LEVELS OF HYDROGEN ATOM AWS ABDO "Quantum fluctuations of empty space a new rosetta stone" in phys dr. H. E. RUTHOFF "The lamb shift and ultra high energy cosmic rays" Sha-Sheng Xue" quantum and classical statistics of the electromagnetic ZPF.

The electromagnetic units 1 produce a polarization of the zero vacuum pairs. The particle-antiparticle pairs occurring in vacuum according to the Heisenberg principle, have magnetic momentum of spin. By means of the action of the magnetic field produced, the electromagnetic units 1 cause the spin of these particle-antiparticle pairs to remain blocked in a spatial region coinciding with the diamagnetic pipe 2 wherethrough the natural gas passes. The heating of the electromagnetic units 1 to the working temperature leads to achieving a powerful connection between the magnetic field of the electromagnetic units 1 and the spin of the zero pairs which occur within the vacuum fluctuations. By increasing the life time of the zero pairs in the conditions of maintaining a constant value of the temperature gradient, the metrics of the space is stabilized for a relatively long period of time, sufficient for the atoms comprised in the natural gas composition to modify their own levels of energy upon their passing through this zone. The natural gas molecule includes this energy in excess caused by the modification of the metrics inside the reactor A and carries the same onto the path inside the pipe 2, this energy in excess being released within the chemical reactions of combusting the natural gas.

While applying the process within the installation claimed by the invention, in compliance with the relation (1), the energy balance is met by the conservation of the total energy during the operation of the installation:

$$Q(+)=E(\text{vacuum})-B(u.e.m.)-e. \quad (1)$$

where:

Q(+) is the supplementary energy obtained relatively to the classical reaction of oxidizing the natural gas;

E (vacuum)—the energy consumed for making the vacuum to fluctuate This energy is spent at a cosmic scale;

B (u.e.m.)—the electric power consumed for obtaining the magnetic field within the electromagnetic units of the reactor;

e—the energy used by the installation for other operations: cooling the oil, heating the oil, setting the oil pump into operation and the like.

The ratio between the supplementary caloric energy obtained and the electric power consumed by the reactor is given by the relation (2)

$$Q(+)/\{(B(u.e.m.)+e\}=24/1. \quad (2)$$

An increase of the gas burning energy takes place in the reactor A, by the action of the 18 electromagnetic units 1 which are maintained during their operation at a certain working temperature. The natural gas is introduced into the installation through the gas conduit at a pressure within 2.5 . . . 3.5 bar, the conduit crosses the tank R, thereby achieving a preheating of the tank to the working temperature of the reactor A, thereafter it undergoes an expansion within the diamagnetic pipe 2. The ratio between the diameter of the pipe 2 passing through the reactor A and the conduit D connected therewith for the natural gas supply ranges between 3 . . . 6. The natural gas slows down its transport speed inside the diamagnetic pipe 2, remaining for 1-2 seconds under the action of the 18 electromagnetic units 1 which determine the modification of the quantum energy levels of the molecules. The electromagnetic units 1 are brought to the working temperature through the action of the heated oil passing through the tanks 7 and carry out the energetic addition within the gas molecule by freezing the space metrics at a quantum level and extracting the zero vacuum energy. After the gas gets out of the diamagnetic pipe 2, it is handled towards the burners, where the caloric excess caused by the extraction of a part of the zero energy of the vacuum is pointed out. By increasing the caloric power, the new quantity of gas to be burnt is smaller than in the situation when the natural gas does not include a part of the zero energy of the vacuum that is extracted in the reactor A.

Thereby, the invention ensures an important economy of natural gas, leading to the substantial reduction of the energy expenses. The invention is liable of being standardized to the effect that it can be sized for any natural gas flow rate chosen for the technological heating processes. The gases resulting from the process of combusting the natural gas, when this is processed from a quantum point of view within the installation, have a small carbon monoxide content as compared to the usual processes of combustion in thermochemistry.

The installation for increasing the caloric power of the natural gas employs the electric power to operate, consequently it is not electromagnetically polluting, it does not release noxious substances into the environment, it is carried out by using usual materials, it is secure and easy to use and to maintain. The ratio between the electric power consumed for operating the reactor A and the supplementary energy extracted from the zero fluctuations of the vacuum is 1/24. The large-scale application of the installation can lead to lowering the heating expenses for the population during the winter, fact that, from a social viewpoint, can be a real advantage. Its application in industry can lead to sensitive reductions of the energy expenses for the energy-consuming production sectors and implicitly to the reduction in price of certain products destined to the market.

The invention claimed is:

1. A process for increasing the combustibility of a natural gas fuel, the process comprising the steps of:

(a) passing, in a continuous flow, a mass quantity of the natural gas fuel through an elongated hollow conduit, the conduit being comprised of diamagnetic material;

(b) exposing the mass quantity of the natural gas fuel within the conduit simultaneously to a rotating magnetic field of one polarity and a rotating thermal field, the rotating magnetic field of one polarity being created by a plurality of electromagnetic units, the plurality of electromagnetic units being arranged in groups vertically on an exterior of the elongated hollow conduit, the groups of electromagnetic units extending orthogonally, and the plurality of electromagnetic units being equidistantly spaced within each group around the circumference of the exterior of the elongated hollow conduit, and the groups of electromagnetic units being offset from each other over a vertical distance of the exterior of the elongated hollow conduit, and the rotating thermal field being created by a core of each of the plurality of the electromagnetic units, wherein the plurality of electromagnetic units are maintained at a temperature between 31° C. and 65° C., the mass quantity of the natural gas fuel, before entering the conduit being pre-heated and having a temperature between 18° C. and 30° C., so that the combustibility of the natural gas fuel is enhanced; and (c) directing the natural gas fuel, thus, treated towards a burner.

2. The process according to claim 1, wherein the plurality of electromagnetic units are supplied with electrical power, the electrical power having the same intensity when the plurality of electromagnetic units are connected in parallel, or the electrical power having different intensities when the plurality of electromagnetic units are connected in series, such that the magnetic field of one polarity decreases along the flow direction of the natural gas fuel within the conduit, wherein the magnetic field of one polarity is between 0.1 and 0.8 T.

3. The process according to claim 1 or 2, wherein each of the plurality of the electromagnetic units generates a magnetic flux ranging between 0.03 and 0.228 Wb, when the plurality of electromagnetic units are connected in series or in parallel.

4. An apparatus for enhancing the combustibility of a natural gas fuel, the apparatus comprising a reactor, the reactor comprising:

a plurality of electromagnetic units;

a hollow conduit, the conduit being comprised of diamagnetic material;

a thermally insulated housing, wherein each of the plurality of electromagnetic units comprises:

a metal core placed inside an electric coil, the electric coil being provided with electrical connection ends; and a heat exchange tank for maintaining the plurality of electromagnetic units at a substantially constant temperature, the plurality of electromagnetic units being arranged in groups vertically on an exterior of the elongated hollow conduit, the groups of electromagnetic units extending orthogonally, and the plurality of electromagnetic units being equidistantly spaced within each group around the circumference of the exterior of the elongated hollow conduit, and the groups of electromagnetic units being offset from each other over a vertical distance of the exterior of the elongated hollow conduit, each electromagnetic unit within a group being shifted relatively to a corresponding electromagnetic unit within a lower group by an angle from about 70° to 73°, such that an angle between an electromagnetic unit of a first group and a corresponding electromagnetic unit of a sixth group is about 360°;

an oil reactor tank, the oil reactor tank comprising electrical resistors for heating the oil;

a pump for circulating the oil through the heat exchange tank of each of the plurality of electromagnetic units;

a radiator for cooling the oil before it is circulated through the heat exchange tank of each of the plurality of electromagnetic units;

an electric panel for supplying electric current to the electric coil of each of the plurality of electromagnetic units; and a natural gas fuel inlet and outlet, the natural gas inlet crossing the reactor where the oil is heated, whereby a rotating magnetic field with a single polarity and a thermal field are created by the plurality of electromagnetic units, the magnetic and thermal fields enhancing the burning energy of the natural gas fuel passing through the conduit.

5. The apparatus according to the claim 4, wherein the heat exchange tank of each of the plurality of electromagnetic units is provided with a supply pipe and a discharge pipe, the supply and discharge pipes being of substantially equal diameters, and the length of the supply pipe being longer than the length of the discharge pipe, the ratio between these lengths being between about 2 and 2.5, and wherein the heat exchange tanks of the plurality of electromagnetic units are connected in series, wherein the supply pipe of one heat exchange tank is connected to the discharge pipe of the following heat exchange tank.

6. The apparatus according to claim 4 or 5, wherein the ratio between the diameter of the natural gas inlet crossing the reactor and the diameter of the conduit has a value ranging between about 3 and 6.

* * * * *